US005520481A

United States Patent [19]

Atchley et al.

[11] Patent Number: 5,520,481

[45] Date of Patent: May 28, 1996

[54] DRAIN FIELD SYSTEM

[75] Inventors: Frederic P. Atchley; Michael D. Maroschak, both of Apopka, Fla.

[73] Assignee: Plastic Tubing Industries, Inc., Orlando, Fla.

[21] Appl. No.: 467,737

[22] Filed: Jun. 6, 1995

Related U.S. Application Data

[63] Continuation-in-part of Ser. No. 219,671, Mar. 23, 1994.

[51] Int. Cl.[6] ..... E02B 11/00

[52] U.S. Cl. ..... 405/43; 405/46; 405/50; 210/170

[58] Field of Search ..... 405/43, 45, 46, 405/50; 210/170, 283, 532.2

[56] References Cited

U.S. PATENT DOCUMENTS

| | | | |
|---|---|---|---|
| 3,060,693 | 10/1962 | Taylor | 405/43 |
| 3,403,519 | 10/1968 | Balko | 405/45 |
| 3,441,140 | 4/1969 | Thurber et al. | 210/170 |
| 4,019,326 | 4/1977 | Herveling et al. | 405/45 |
| 4,134,268 | 1/1979 | Elmore | 405/43 |
| 4,246,305 | 1/1981 | Delattre | 405/50 X |
| 4,588,325 | 5/1986 | Seefert | 405/46 |
| 4,824,287 | 4/1989 | Tracy | 405/36 |
| 4,907,385 | 3/1990 | Biodrowski | 405/50 X |
| 4,950,103 | 8/1990 | Justice | 405/43 |
| 5,015,123 | 5/1991 | Houck et al. | 405/45 |
| 5,378,357 | 1/1995 | Huock et al. | 403/43 |

*Primary Examiner*—Stephen J. Novosad

*Attorney, Agent, or Firm*—Allen, Dyer, Doppelt, Franjola & Milbrath

[57] ABSTRACT

A drain field and a drain field assembly for use with a sewage disposal system are provided that do not require the use of aggregate in the form of rock, gravel, shale, or the like. The assembly contains a distribution pipe having a plurality of holes disposed along its bottom half for receiving liquid effluent. Alongside and beneath the distribution pipe are positioned a plurality of void pipes having holes and slots therein that serve to retain and distribute the effluent received from the distribution pipe. Draped over the top and along the sides of the assembly is a protective sheeting that is impervious to soil and liquid permeable that serves to keep soil from entering the pipes and also to aid in evapotranspiration. The drain field of the present invention contains the assembly positioned within a trench and covered with backfill material.

22 Claims, 7 Drawing Sheets

DRAIN FIELD SYSTEM

CROSS-REFERENCE TO RELATED APPLICATION

This application is a continuation-in-part to the copending application, "Drain Field System," Ser. No. 08/219,671, filed Mar. 23, 1994.

BACKGROUND OF THE INVENTION

1. Field of the Invention

The present invention relates to sewage disposal systems and, more particularly, to an improved rockless drain field system using multiple corrugated drain pipes.

2. Description of Related Art

Traditional sewage systems, such as those used for disposing waste from homes that are not connected to sewer lines, typically comprise a concrete, plastic, or steel septic tank into which both solid and liquid waste flow. The tank has one or more compartments through which the sewage flows horizontally and is kept out of contact with the air for a minimum of 24 hours. Spontaneous biological action liquefies much of the organic matter, while fine particles settle to the bottom, where bacteria convert some of the organic matter into methane and carbon dioxide. The solid matter either decomposes or is periodically pumped out of the tank.

The liquid flows out of the septic tank through a perforated pipe surrounded by loose aggregate, usually a bed of rock or gravel. The soil itself then continues the filtering process, and the liquid ultimately returns to the ground water.

The installation of such sewage systems entails digging a trench into which is poured aggregate in the form of rock, crushed stone, or gravel. The perforated pipe is then laid down on the aggregate, and additional aggregate is added to a required depth. The top layer consists of soil cover, preferably planted, to facilitate surface water runoff.

Conventional systems require a considerable amount of skilled labor and expensive materials. The installations must meet stringent state and local codes, and must often take place in difficult terrain. For instance, suitable fill material is often difficult to obtain, since the aggregate must meet size and cleanliness requirements.

An additional problem with currently used systems is that the aggregate material, being of nonuniform sizes, has variable properties with regard to retention and evenness of distribution. The aggregate is capable of sealing off with sewage material, which prevents further filtration at such sealed off sites.

Another problem with conventional systems is that the perforated pipe through which the fluid exits the septic tank is typically buried 2 feet beneath the surface. This depth can both hinder evapotranspiration of liquids into the atmosphere and can also cause backup with as little as 10 inches of rainfall, depending on the soil and water table conditions.

A previous rockless drain field system has been described by Seefert (U.S. Pat. No. 4,588,325). The apparatus disclosed therein comprises a distribution pipe having perforations suspended above an empty trench. The pipe is suspended above the trench bottom within a channel formed by a plurality of mesh-like channel forming members. In overlying relation to these members is a porous length of sheet goods, through which evapotranspiration occurs.

Another rockless drain field system is disclosed by Houck et al. (U.S. Pat. No. 5,015,123). This system provides a preassembled drainage line unit comprising a perforated conduit surrounded by loose aggregate. The aggregate is bounded by a perforated sleeve, through which liquid may pass into the soil.

SUMMARY OF THE INVENTION

It is an object of the present invention to provide a drain field system that does not require the addition of aggregate material.

It is a further object to provide a system that has uniform retention and distribution properties.

It is another object to provide a system that has improved transpiration properties.

It is yet an additional object to provide a system that has improved capacity and flow over conventional systems.

It is a further object to provide a prepackaged system that is less labor intensive than currently used systems.

It is yet another object to provide a system that has increased longevity and is environmentally sound.

It is yet an additional object to provide a system that has fluid retention time as a variable.

The foregoing objects are achieved with the drain field and drain field assembly of the present invention, which form a part of an improved drain field system.

The drain field assembly disclosed herein has a top edge, a bottom edge, and two sides for use with a sewage disposal system. The assembly comprises a generally cylindrical distribution pipe for receiving liquid effluent from the sewage disposal system. The distribution pipe has an inlet at a first end, a second end, a cylindrical axis, a cylindrical cross section, a bottom half defined by an imaginary plane bisecting the distribution pipe along the cylindrical axis and through the cylindrical cross section, and a wall. The distribution pipe further has a plurality of holes through the wall distributed along the bottom half. In one embodiment the second end is capped.

The assembly also comprises a plurality of generally cylindrical void pipes for receiving effluent from the distribution pipe, retaining the effluent for a time, and distributing the effluent to an area of soil. Each void pipe has a cylindrical axis, a wall, and a plurality of holes through the wall. In an alternate embodiment each void pipe also comprises a plurality of slots through the wall that are smaller than the holes.

In use a protective soil-impervious, liquid-permeable sheeting is placed to surround the top edge and the two sides of the assembly for protecting the holes in the distribution pipe and the holes and slots in the void pipes from intrusion by soil.

When the assembly is formed, the distribution pipe is positioned along the top edge of the assembly with its bottom half facing the bottom edge of the assembly. The distribution pipe and the void pipes are situated in a plurality of adjacent rows. The cylindrical axes of the distribution pipe and the void pipes are arranged generally parallel to each other and to the sides of the drain field assembly, and one row of void pipes is disposed along the bottom edge of the assembly.

In one embodiment of the assembly, the holes in the distribution pipe are disposed in two generally straight, generally parallel lines, which are generally parallel to the cylindrical axis. In this embodiment, the holes in the void pipes are disposed in a plurality of generally straight, generally parallel lines, which are generally parallel to the cylindrical axis.

In an exemplary embodiment the plurality of adjacent rows takes the form of three rows. The top row of the assembly comprises one distribution pipe. The center row comprises two void pipes, and the bottom row of the assembly comprises three void pipes. The rows are disposed in a close-packed arrangement, wherein the cylindrical axes of any three adjacent pipes define an equilateral triangle in a cross section normal to the cylindrical axes.

In another embodiment of the assembly, the plurality of adjacent rows takes the form of two rows. In each case the top row comprises a distribution pipe, and the bottom row comprises a plurality of void pipes.

The drain field of the present invention comprises the drain field assembly as described above situated in a generally rectangular trench with its bottom edge facing downward and covered over with backfill material. In operation, the distribution pipe receives liquid effluent from a sewage disposal system, usually a septic tank, through its inlet at the first end.

The features that characterize the invention, both as to organization and method of operation, together with further objects and advantages thereof, will be better understood from the following description used in conjunction with the accompanying drawing. It is to be expressly understood that the drawing is for the purpose of illustration and description and are not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

A description of the preferred embodiments of the present invention will now be presented with reference to FIGS. 1–11.

Figure 1:
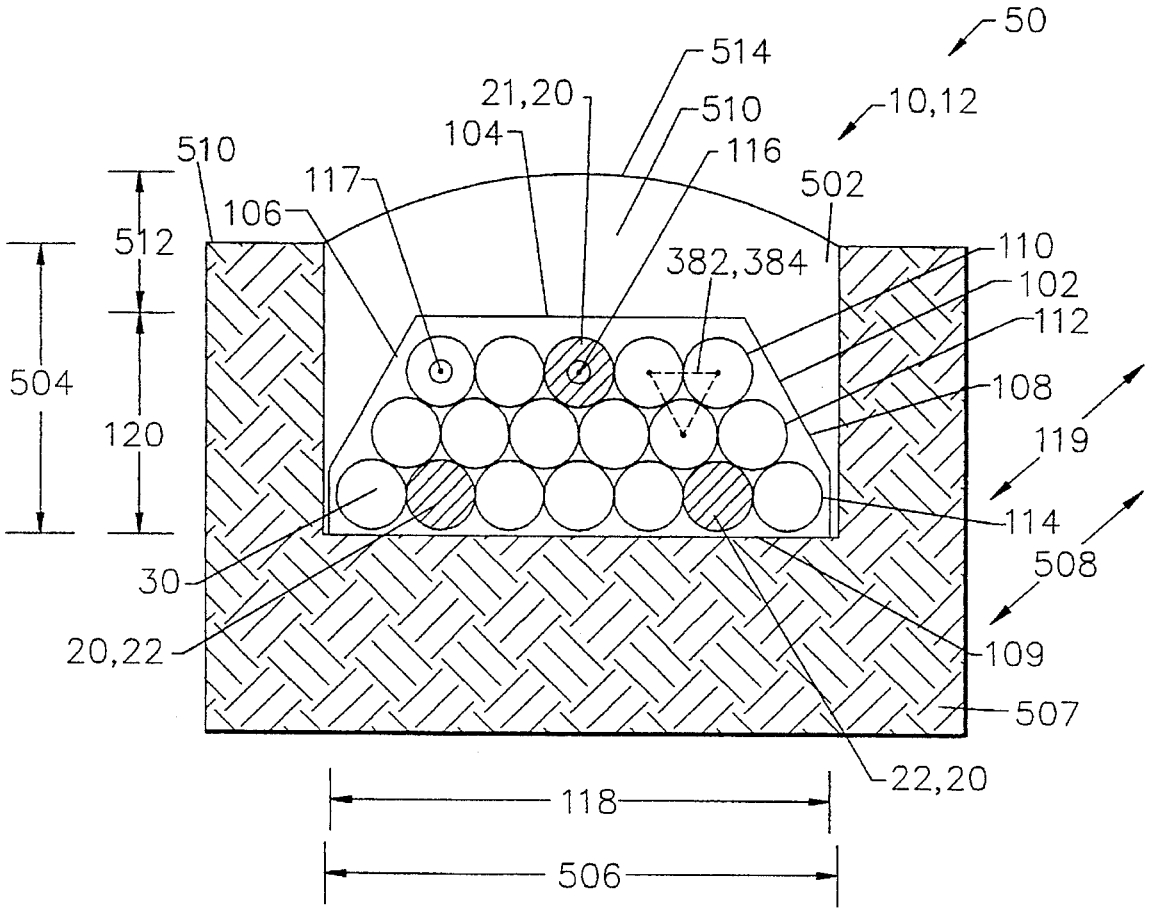
FIG. 1 is a cross-sectional view of the assembly of pipes draped with a cloth cover and situated in a trench.

FIG. 1 illustrates a cross-sectional view of an exemplary embodiment of the drain field assembly of the present invention, referred to generally by the reference numeral be, has a width 118, a length 119, and a height 120. Drain field assembly 10 comprises a plurality of generally cylindrical perforated pipes having a protective sheeting 102 covering its top 104 and both sides 106 and 108 but not its bottom 109. The pipes include three distribution pipes 20 (shaded in FIGS. 1 and 8) and a plurality of void pipes 30 disposed in a plurality of adjacent rows wherein the cylindrical axes 116 and 117, respectively, of the pipes are generally parallel to each other and to the sides 106 and 108. One primary distribution pipe 21, the one to be connected to the source of effluent, is positioned in the first row 110 of the assembly be.

In general, the assembly functions as follows (see also FIGS. 2–5): Liquid effluent from a sewage disposal system such as a septic tank is channeled into primary distribution pipe 21. The effluent trickles out of the holes 208 in primary distribution pipe 21 into void pipes 30, from which the effluent subsequently trickles into other void pipes 30 and secondary distribution pipes 22, after being retained for a time within the void pipes 30, and ultimately into the ground. Note that primary 21 and secondary 22 distribution pipes are identical in structure and differ only in their connectivity to the effluent source. The placement of these distribution pipes will be discussed in the following.

Figure 2:
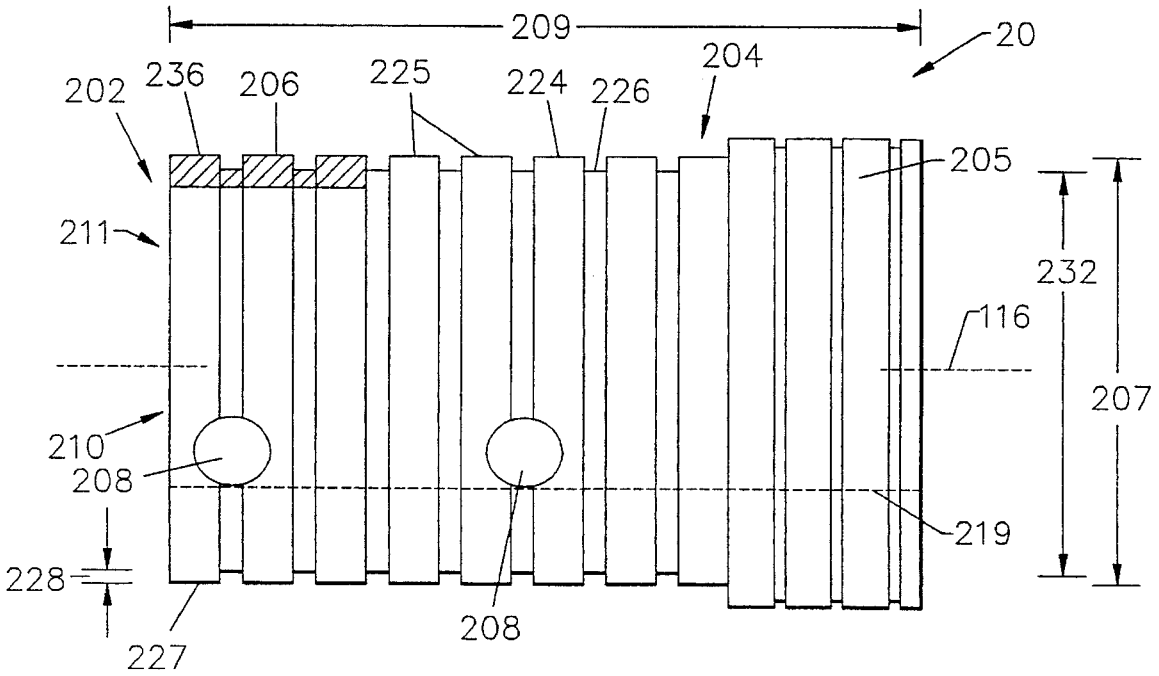
FIG. 2 is a side view of a distribution pipe of the system of the present invention having two rows of holes.
Figure 3:
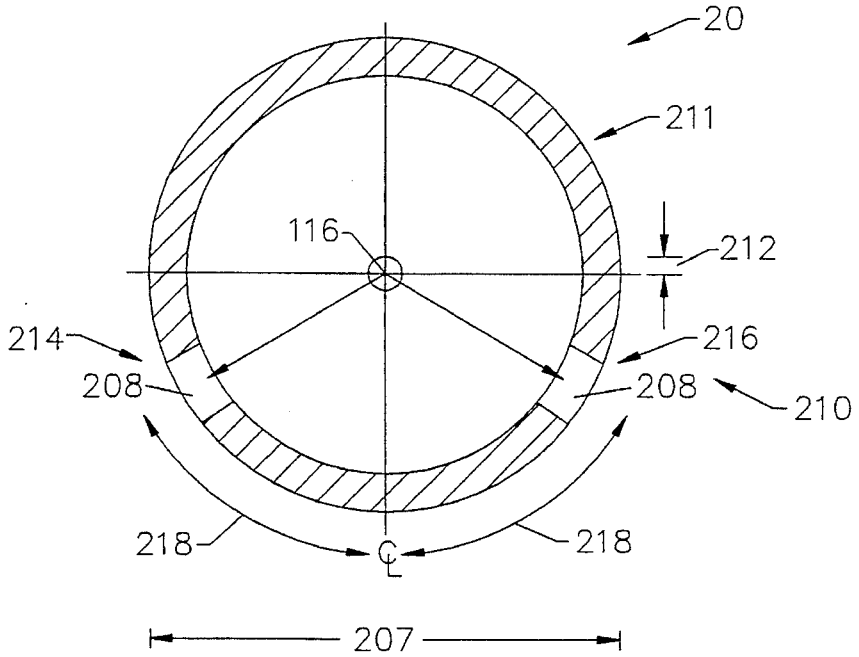
FIG. 3 is an end view of the distribution pipe.

FIGS. 2 and 3 illustrate a side and an end view, respectively, of distribution pipe 20. The side view in FIG. 2 depicts an inlet at a first end 202, a second end 204, a cylindrical axis 116, a wall 206, and a plurality of holes 208. In the embodiment shown, the second end 204 further comprises a generally cylindrical cap 205 dimensioned to closely engage second end 204 for preventing liquid effluent from escaping out second end 204 and for preventing soil from entering second end 204. Holes 208 are shown disposed along the second half 210 of distribution pipe 20, which is defined by the area of pipe 20 below an imaginary plane 212 longitudinally bisecting distribution pipe 20 along cylindrical axis 116, as is shown in FIG. 3. First half 211 is likewise defined by the area of pipe 20 above the imaginary plane Holes 208 in a preferred embodiment are disposed in two generally straight, generally parallel lines 214 and 216, the lines being generally parallel to the cylindrical axis 116. In FIG. 3, it is shown that these lines 214 and 216 of holes 208 are spaced at an angle 218 of approximately 120 degrees from each other. It can be seen that flow line 219, which is parallel to the cylindrical axis 116 and runs beneath the lines of holes 214 and 216, defines the volume of liquid effluent that can be retained in distribution pipe 20.

In addition, a marking such as reference stripe 236 is disposed on the first half 211 midway between the lines 214 and 216 of holes 208. Stripe 236 permits the accurate positioning of distribution pipe 20 so that the lines 214 and 216 of holes 208 define equal angles 218 with level ground to maximize liquid effluent distribution.

Figure 4:
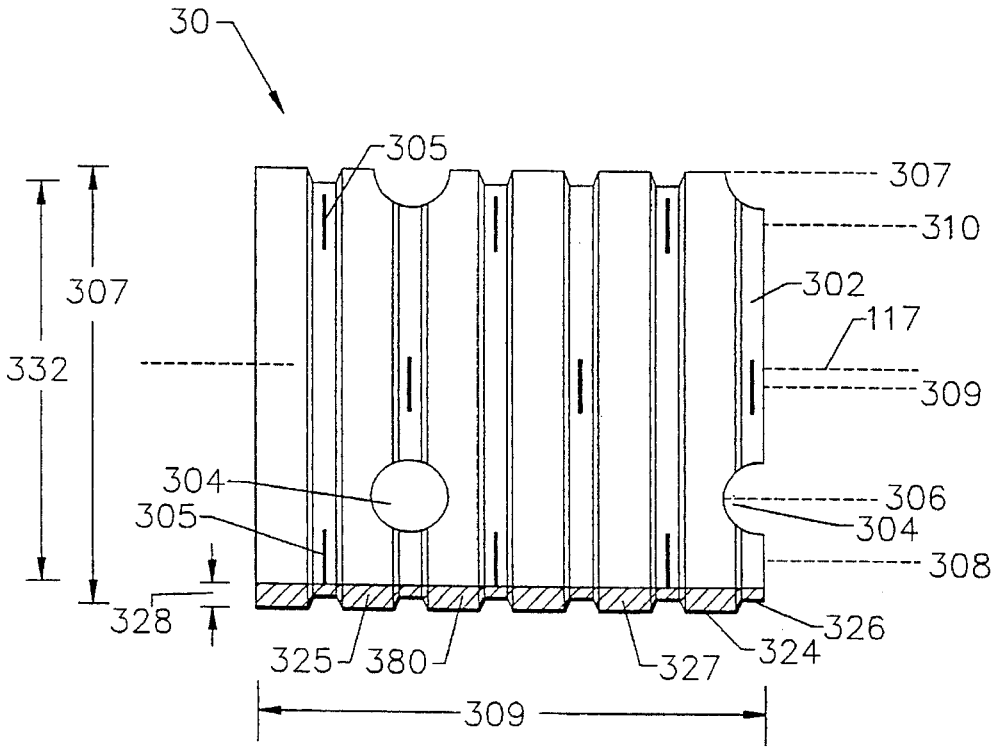
FIG. 4 is a side view of a void pipe.
Figure 5A:
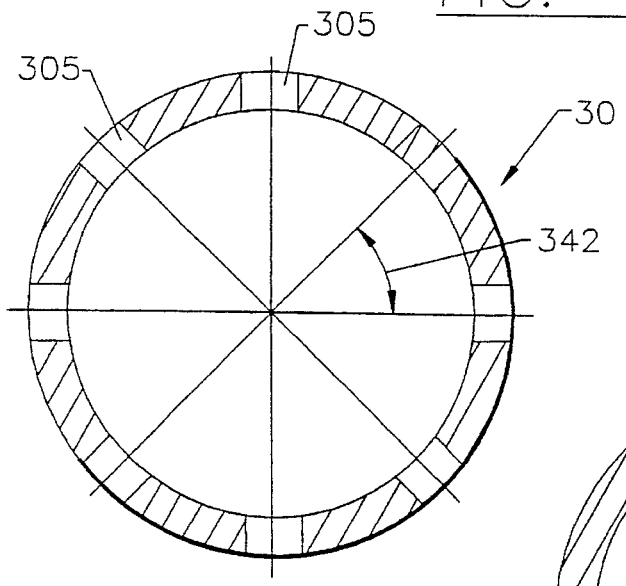
FIGS. 5(*a*) and 5(*b*) illustrate the placement of (a) slots and (b) holes in the void pipe.
Figure 5B:
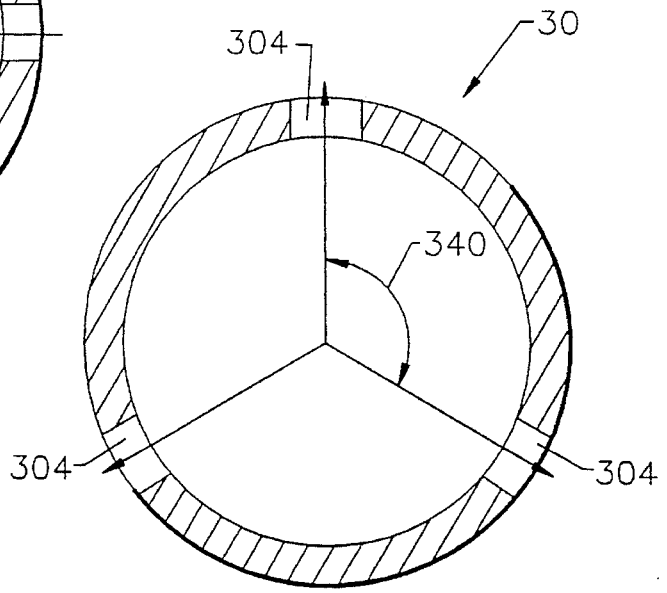

Each void pipe 30, shown in FIGS. 4 and 5(*a*) and (*b*), is a generally cylindrical pipe that has a cylindrical axis 117, a wall 302, and a plurality of holes 304 and of slots 305 through the wall 302. Slots 305 are smaller than holes 304. In a preferred embodiment, the holes 304 in void pipes 30 are disposed in a plurality of generally straight, generally parallel lines, two of which are shown in side view in FIG. 4 as 306 and 307. Also in a preferred embodiment, the slots 305 are disposed in a plurality of generally straight, generally parallel lines, three of which are shown in side view in FIG. 4 as 308, 309, and 310. Lines 306–310 are generally parallel to the cylindrical axis 117. Generally there are three lines of holes and eight lines of slots, the circumferential distribution thereof shown in FIG. 5(*a*) and (*b*).

As is shown in FIGS. 2 and 4, distribution pipe 20 and void pipes 30 comprise corrugated pipes, in one embodiment having diameters 207 and 307, respectively, of 4 inches and a lengths 209 and 309, respectively, of 10 feet. The corrugations 225 in distribution pipe 20 are defined by regions of larger diameter 224 and smaller diameter 226. The regions of larger diameter 224 define a valley 227 having a depth 228 defined by one-half the difference between the larger diameter 207 and the smaller diameter 232. Holes 208 are distributed generally in regions of smaller diameter 226.

The corrugations 325 in void pipe 30 are defined by regions of larger diameter 324 and-smaller diameter 326. The regions of larger diameter 324 define a valley 327 having a depth 328 defined by one-half the difference between the larger diameter 307 and the smaller diameter 332. In the embodiment of the void pipe 30 shown in FIG. 4, holes 304 are distributed in regions of smaller diameter 326 such that each line comprises holes in every fourth region of smaller diameter 326. Each adjacent line of holes (proceeding circumferentially about the void pipe 30) has a series of holes positioned in the same region of smaller diameter 326. As shown in FIG. 5(*b*), the three lines of holes are distributed at an angle 340 generally 120 degrees apart.

Slots 305, dimensioned to permit liquids to pass therethrough, are distributed in regions of smaller diameter 326 such that each line comprises slots in alternating regions of smaller diameter 326. Each adjacent line of holes has a series of holes staggered by one region of smaller diameter 326. As shown in FIG. 5(*a*), in a preferred embodiment eight lines of slots 305 are distributed at an angle 342 generally 45 degrees apart.

Should the slots 305 become clogged when in use, the holes 304 provide an outlet for effluent.

It can be seen that the flow, distribution, and retention properties of drain field assembly 10 can be altered in several ways and thus can be tailored to specific sites, applications, and volume demands. For instance, fluid retention time is a function of depths 228 and 328 of the valleys 226 and 326; the size, number, and placement of holes 208 and 304; and the lengths 209 and 309 and diameters 207 and 307 of pipes 20 and 30, respectively. In addition, one can alter the number of void pipes 30 in the assembly 10 to adjust the time it takes fluid to trickle from distribution pipe 20 through the plurality of void pipes 30 into the soil. The placement of holes 208 and 304 relative to the corrugations in pipes 20 and 30 can also be seen to affect retention time: If the holes 208 and 304 are placed in regions of smaller diameter 226 and 326, retention time is greater than if placed in regions of larger diameter 224 and 324. As an example, the darkened area 380 at the bottom of FIG. 4 illustrates fluid retention volume in pipe Protective sheeting 102 comprises a soil-impervious, liquid-permeable fabric that is draped over the top 104 and the sides 106 and 108 of assembly 10. The soil-impervious nature of the sheeting 102 protects the holes 208 and 304 in pipes 20 and 30, respectively, from being clogged by surrounding soil. The liquid-permeable nature of the sheeting 102 permits improved liquid distribution properties because, as sheeting 102 is forced against holes 304 in void pipes 30, more contact area is created with the effluent being discharged.

In the preferred embodiment, protective sheeting 102 comprises a spun-bonded, nonwoven fabric. Such fabrics may include nylon or polyester. In the preferred embodiment a fabric known as Tile guard (Remay™, Style 2005 or 2015, DuPont, Wilmington, Del.) is used.

In a preferred embodiment, returning to FIG. 1, the drain field assembly's adjacent rows comprise a top row 110 along the top of the assembly, a center row 112, and a bottom row 114 along the bottom of the assembly 10. Top row 110 comprises the primary distribution pipe 21. Primary distribution pipe 21 is positioned having its second half 210 facing the bottom 109 of the assembly. Center row 112 comprises two void pipes 30. Bottom row 114 comprises three void pipes. These three rows are disposed in a close-packed arrangement, wherein the cylindrical axes 116 or 117 of any three adjacent pipes define an equilateral triangle 382 in the cross-sectional plane 384, the plane of FIG. 1, normal to the cylindrical axes 116 and 117. In a preferred embodiment, which employs 4-inch-diameter, 10-feet-long corrugated pipes, the assembly 10 has a width 118 of 18 inches and a height 120 of 15 inches.

The drain field of the present invention, shown FIG. 1 and referred to generally by the reference number 50, comprises a drain field assembly 12 positioned with its bottom 109 facing downwards in a generally rectangular trench 502 having a depth 504 beneath ground level 510, a width 506, and a length 508. In a preferred embodiment for a single assembly 12, trench width 506 may be 24 or 36 inches. Depth 504 should be not less than 24 inches nor more than 30 inches. The width 118 and the length 119 of drain field assembly 12 are dimensioned to reside within trench 502. In order to maximize the uniformity of liquid effluent distribution, it is preferred to position assembly 12 so that cylindrical axes 116 and 117 are generally parallel to level ground. Trench 502 is surrounded by undisturbed earth 507.

Drain field 50 further comprises backfill material sufficient to cover drain field assembly 10 (see FIG. 1). The amount of backfill cover 512 is the difference between the top of assembly 10 and the top 514 of the drain field 50, which may or may not be even with level ground level 510. If the top 104 of assembly 10 is greater than the depth 504 of trench 502, assembly 10 and backfill material 510 form a mound. When constructed, cover 512 should include at least 2 inches of overfill to allow for settling.

Figure 8:
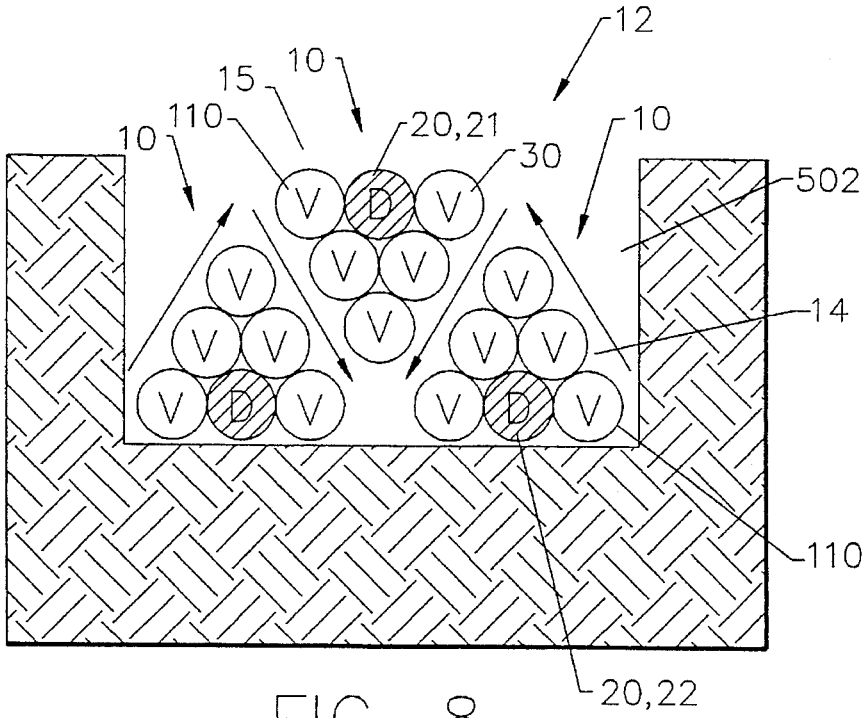
FIG. 8 illustrates the placement of three subassemblies in the eighteen-pipe embodiment.

The embodiment of assembly 12 shown in FIGS. 1 and 8 comprises a plurality of (here, three) prebundled subassemblies, the subassemblies equivalent to the above-discussed assembly 10, each containing one distribution pipe 20 and five void pipes 30. The subassemblies are situated so that all of the distribution pipes and the void pipes 30 are generally parallel to each other and to the sides 106, 108 of the drain field assembly 12, with one row comprising void pipes along the bottom of the assembly. The subassemblies 10 are positioned so that the resulting assembly 12 has the primary distribution pipe 21 at the center of the top row 110 to ensure optimum effluent distribution among the pipes.

The placement of the bundled subassemblies 10 in practice is achieved as follows (FIG. 8): Two subassemblies 13 and 14 are placed side by side in trench 502. The orientation of these subassemblies is immaterial; those shown in FIG. 8 are placed with their first rows 110 on the bottom, although this is not necessary. The orientation of the third subassembly 15 is, however, important, since the primary distribution pipe 21 must be at the top of the assembly 12. This is achieved by orienting the third subassembly with the third row 114 on the bottom and the first row 110 on the top. The commercial and practical benefit of using such subassemblies is that the six pipes can be prebundled for shipping and installed easily as shown in FIG. 8, with only the placement of the third subassembly being critical, and this is aided by reference stripe 236 on distribution pipe 20.

Figure 6:
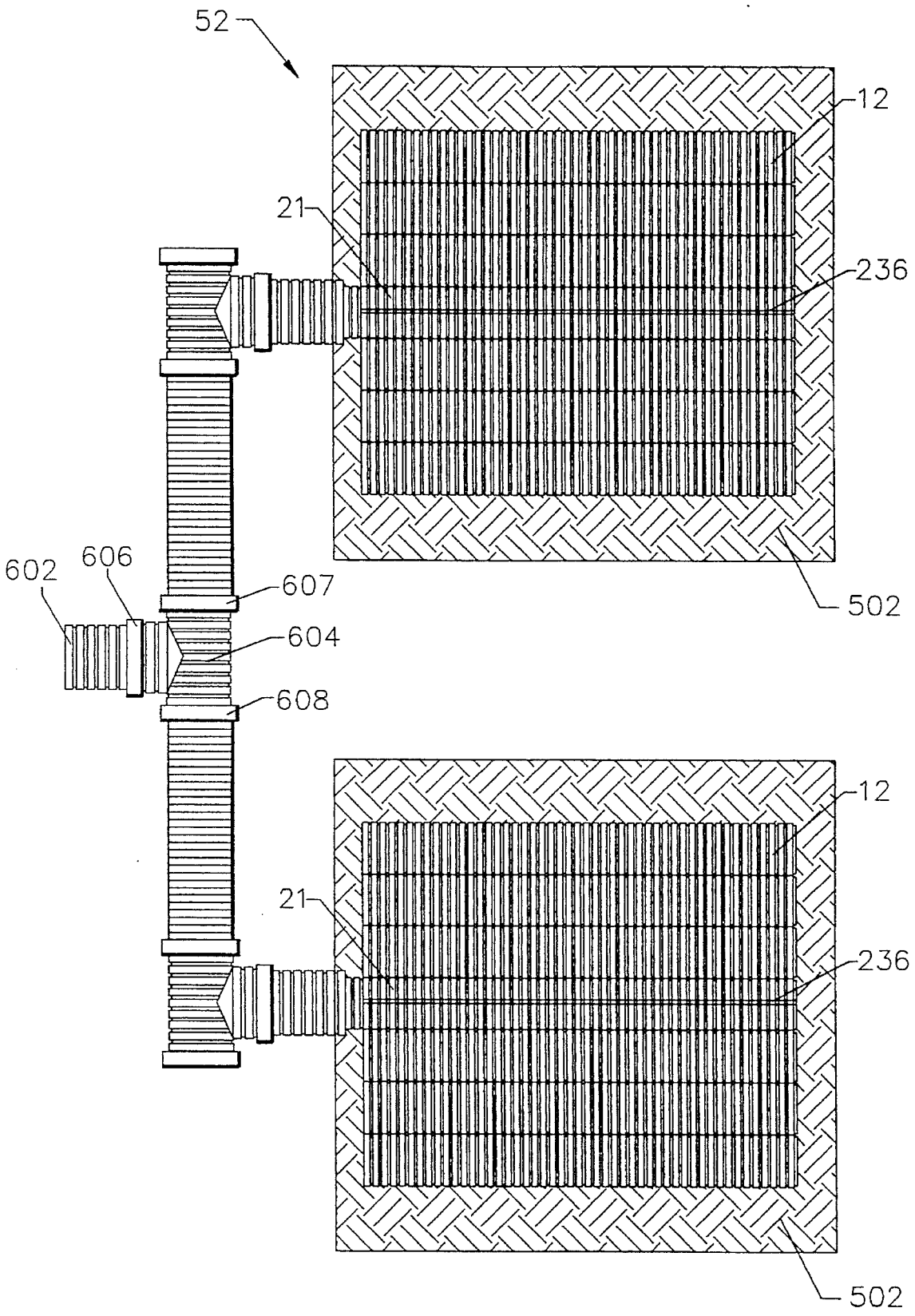
FIG. 6 illustrates the use of a "T" connector through which effluent is fed to a pair of assemblies in parallel trenches.
Figure 7:
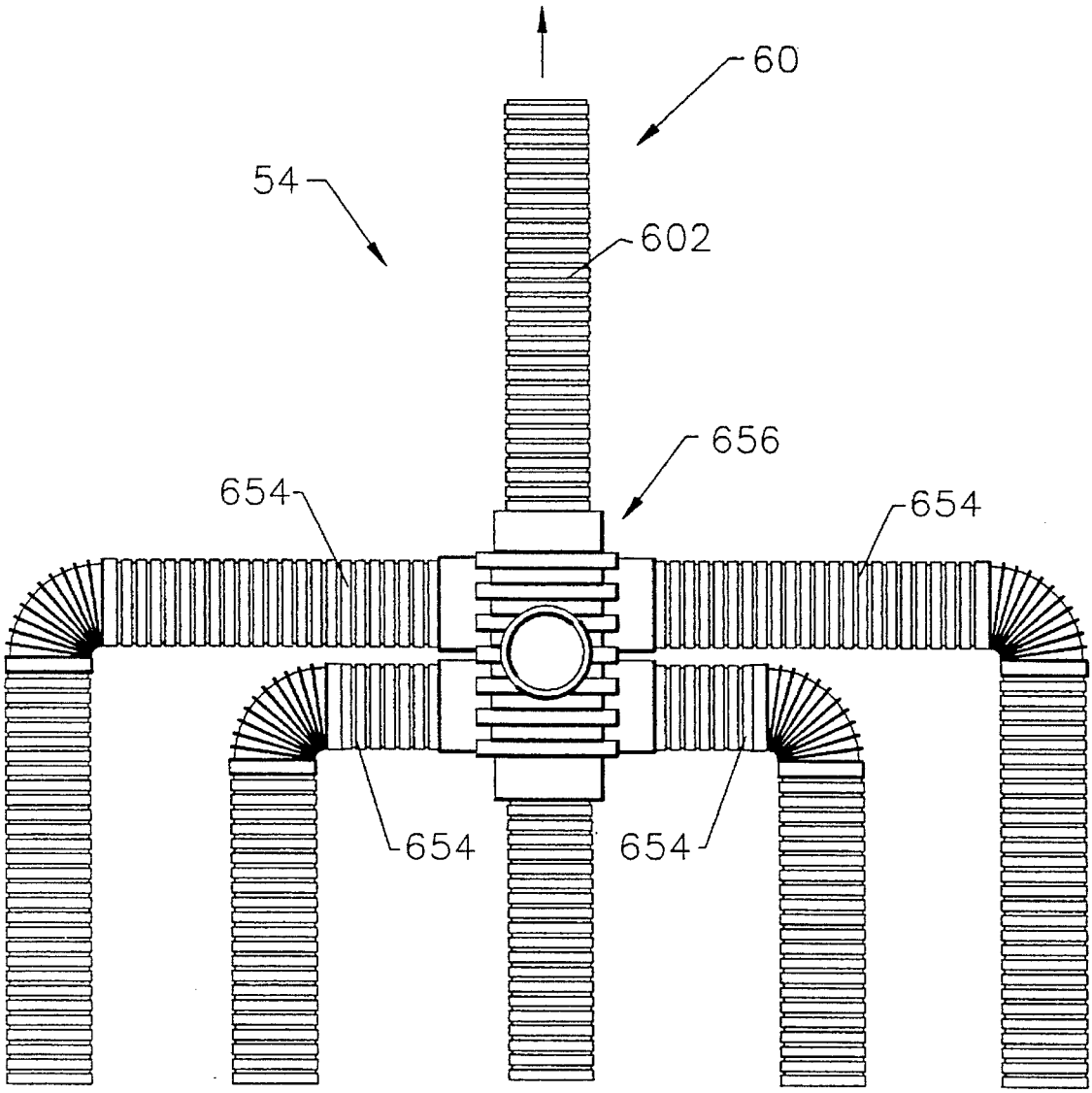
FIG. 7 is an alternate embodiment of a trench system having a plurality of trenches with pipe assemblies connected through a distribution box.

Two embodiments of drain field 50 are illustrated in plan view in FIGS. 6 and 7. The drain field 52 illustrated in FIG. 6 shows a first and a second generally rectangular trench 502 having a depth below ground level and positioned generally parallel to each other. Each trench 502 has a single assembly 12 placed therein, with the assembly bottom 109 facing downward. An effluent pipe 602 is connected to an outlet of the sewage disposal system. A "T" connector 604 is connected at its inlet 606 to the effluent pipe 602 and distributes effluent through two outlets 607,608 that are in turn connected to the primary distribution pipes 21 of the subassemblies 12.

A further drain field 54 is illustrated in FIG. 7, wherein a plurality of generally parallel trenches contain a plurality of assemblies 12 (not shown). Assemblies 12 receive liquid effluent from a sewage disposal system via an effluent pipe 602 exiting from the sewage system 60, pipe 602 being connected to a plurality (here, five) of connecting pipes 654 via a distribution box 656.

In another embodiment of the drain field assembly, two adjacent rows are provided, including a top row along the top of the assembly and a bottom row along the bottom of the assembly. The top row includes a distribution pipe, and the bottom row includes a plurality of void pipes. As previously, the rows are disposed in close-packed arrangement, the cylindrical axes of any three adjacent pipes defining an equilateral triangle in a plane normal to the cylindrical axes.

Figure 9:
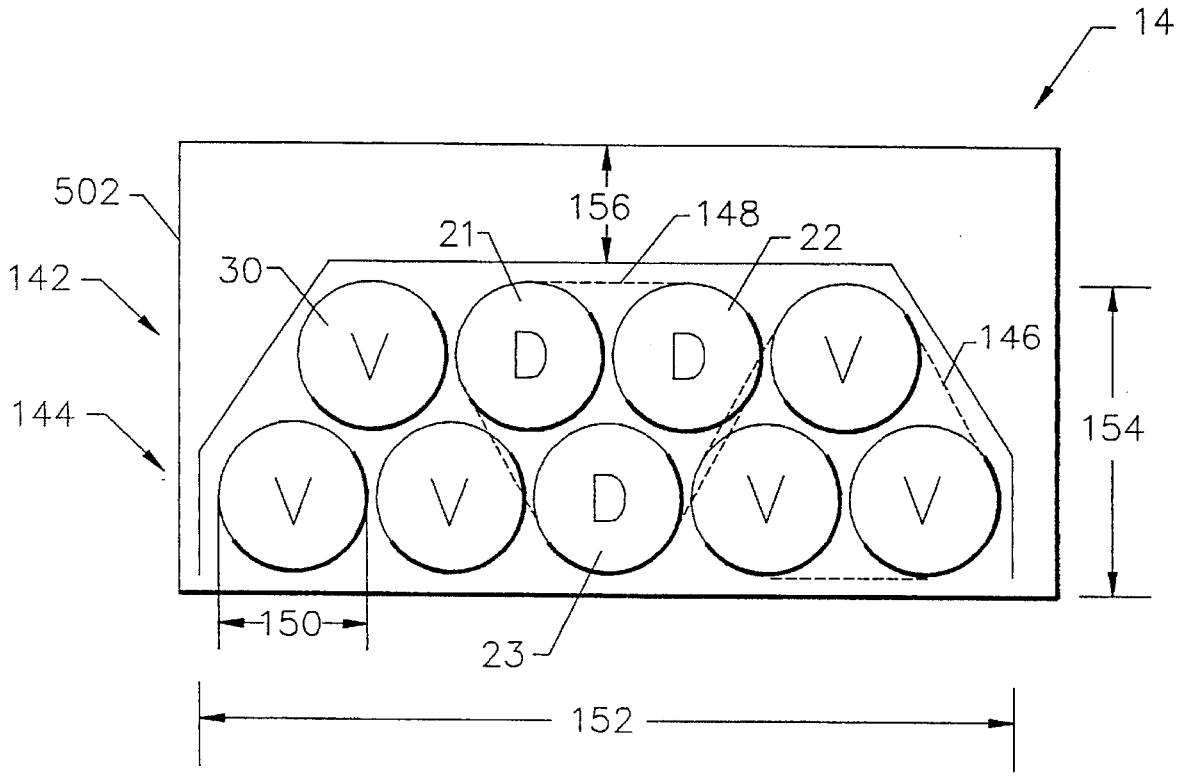
FIG. 9 is a cross-sectional view of a nine-pipe embodiment.

A first subembodiment 14 of this drain field assembly, shown in FIG. 9, contains a total of nine pipes. The top row 142 comprises one void pipe 30 on either side of two distribution pipes 20. The primary distribution pipe 21 is for receiving effluent, as before, and the secondary distribution pipe 22 serves the same function as a void pipe.

The bottom row 144 comprises two void pipes 30 on either side of a third distribution pipe 23 that is not connected to the source of effluent and also serves the same function as a void pipe.

The purpose for this arrangement is for ease of installation. Two subassemblies are prebundled for shipping: A first type 146 of subassembly comprises three void pipes 30; a second, three distribution pipes 20. In both types the pipes are bundled in a close-packed arrangement. The subassemblies are then placed in a trench as shown in FIG. 9, with one void pipe subassembly 146 on either side of a distribution pipe subassembly 148, the void pipe subassemblies 146 pointing "upward" and the distribution pipe subassembly 148 pointing "downward." This provides the benefit that the distribution pipe subassembly 148 can be placed in the trench 502 in any orientation. Then either of the two distribution pipes 20 in the top row 142 is connected to the source of effluent.

Subembodiment 14 is preferably dimensioned as follows, although these measurements are not intended to be limiting: pipe diameter 150 4.625 in., width 152 22.125 in., height 154 9.25 in., and backfill cover 156 10 in.

Figure 10:
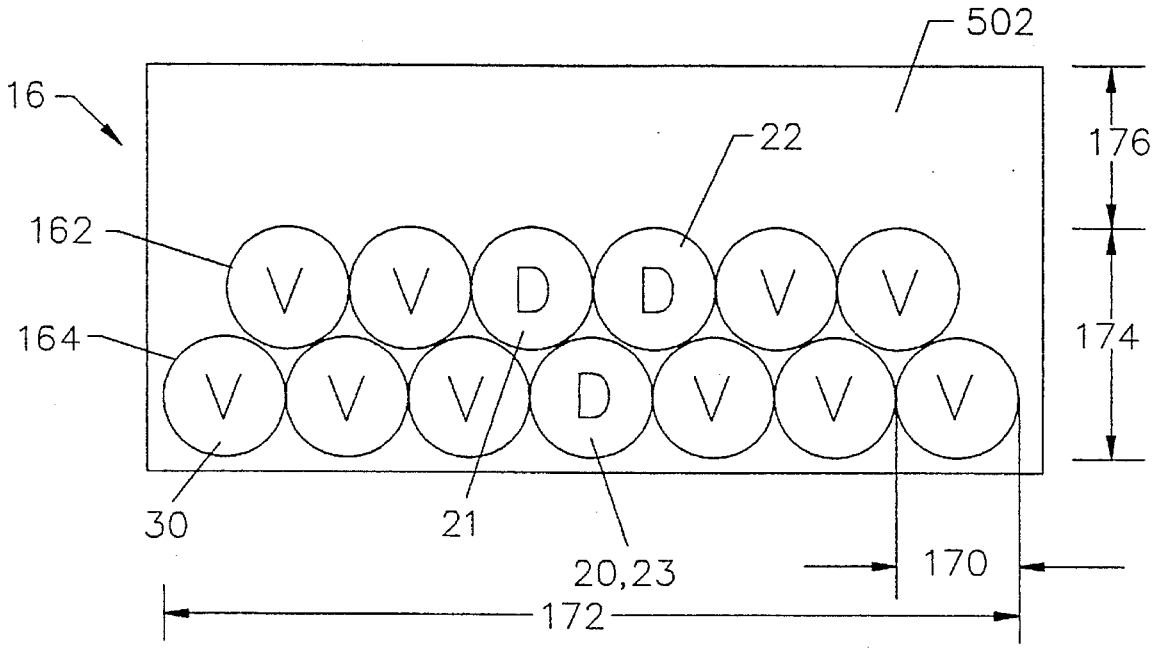
FIG. 10 is a cross-sectional view of a thirteen-pipe embodiment.
Figure 11:
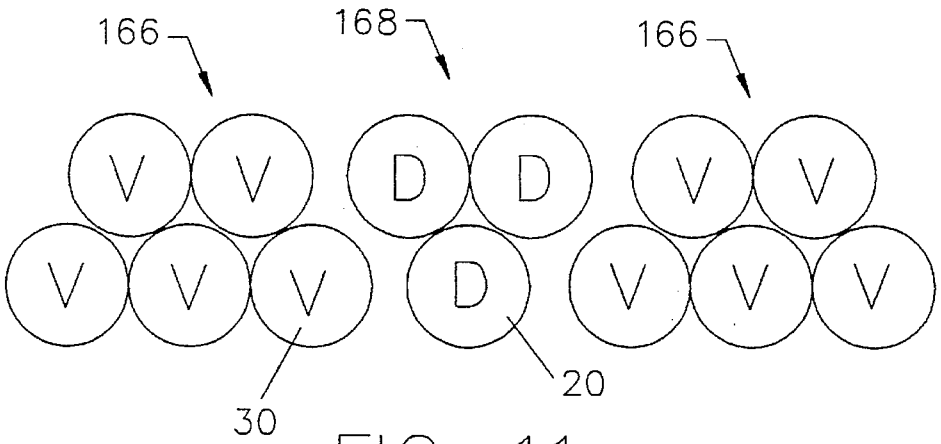
FIG. 11 illustrates the placement of three bundles to form the thirteen-pipe embodiment.

A second subembodiment 16 of this drain field assembly, shown in FIG. 10, contains a total of thirteen pipes. The top row 162 comprises two void pipes 30 on either side of two distribution pipes 20. The primary distribution pipe 21 is for receiving effluent, as before, and the secondary distribution pipe 22 serves the same function as a void pipe.

The bottom row 164 comprises two void pipes 30 on either side of a third distribution pipe 23 that is not connected to the source of effluent and also serves the same function as a void pipe.

The purpose for this arrangement is likewise for ease of installation. Two subassemblies are prebundled for shipping (see FIG. 11): A first type of subassembly 166 comprises five void pipes 30; a second, three distribution pipes 20. In both types the pipes are bundled in a close-packed arrangement. The first type 166 consists of two void pipes 30 atop three void pipes 30. The second type 168 consists of three distribution pipes 20. The subassemblies 166, 168 are placed in a trench 502 as shown in FIG. 10, with one void pipe subassembly 166 on either side of a distribution pipe subassembly 168. Then either of the two distribution pipes 20 in the top row 162 is connected to the source of effluent.

Subembodiment 16 is preferably dimensioned as follows, although these measurements are not intended to be limiting: pipe diameter 170 4.625 in., width 172 36 in., height 174 9.25 in., and backfill cover 176 10 in.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A drain field assembly having a top, a bottom, and two sides for use with a sewage disposal system, the assembly comprising:

a generally cylindrical distribution pipe for receiving liquid effluent from the sewage disposal system, the distribution pipe having an inlet at a first end, a second end, a cylindrical axis, a cylindrical cross section, a first half and a second half defined by an imaginary plane bisecting the distribution pipe along the cylindrical axis and through the cylindrical cross section, a wall, and a plurality of holes through the wall, the holes distributed along the second half;

a plurality of generally cylindrical void pipes for receiving effluent from the distribution pipe, retaining the effluent for a time, and distributing the effluent to an area of soil, each void pipe having a cylindrical axis, a wall, a plurality of holes through the wall, and a plurality of slots through the wall, the slots smaller than the holes; wherein:

the distribution pipe is positioned along the top of the assembly with the second half facing the bottom of the assembly; and the distribution pipe and the void pipe are situated in a plurality of adjacent rows, the cylindrical axes of the distribution pipe and the void pipes generally parallel to each other and to the sides of the drain field assembly, with one row comprising void pipes along the bottom of the assembly.

2. The drain field assembly recited in claim 1, wherein the second end of the distribution pipe is capped for preventing liquid effluent from escaping out from the second end, and further for preventing soil from entering the second end.

3. The drain field assembly recited in claim 1, wherein the holes in the distribution pipe are disposed in two generally straight, generally parallel lines, the lines generally parallel to the cylindrical axis.

4. The drain field assembly recited in claim 3, wherein the two lines of holes are spaced at an angle of approximately 120 degrees from each other.

5. The drain field assembly recited in claim 1, wherein the holes and the slots in the void pipes are disposed in a plurality of generally straight, generally parallel lines, the lines generally parallel to the cylindrical axis.

6. The drain field assembly recited in claim 1, wherein the distribution pipe and the void pipes comprise corrugated pipes having alternating regions of larger diameter and smaller diameter, each region of larger diameter defining a valley having a depth defined by the difference between the larger diameter and the smaller diameter.

7. The drain field assembly recited in claim 6, wherein the holes in the distribution pipe are disposed in generally straight, generally parallel lines, the lines generally parallel to the cylindrical axis, the holes further disposed in regions of larger diameter.

8. The drain field assembly recited in claim 6, wherein the holes in the distribution pipe are disposed in generally straight, generally parallel lines, the lines generally parallel to the cylindrical axis, the holes further disposed in regions of smaller diameter.

9. The drain field assembly recited in claim 8, wherein:

the holes and the slots in the void pipes are disposed in a plurality of generally straight, generally parallel lines, the lines generally parallel to the cylindrical axis;

the plurality of lines comprises at least three lines of holes, each line of holes comprising a hole disposed in every fourth region of smaller diameter; and the plurality of lines further comprises at least six lines of slots, each line of slots comprising slots disposed in alternating regions of smaller diameter.

10. The drain field assembly recited in claim 9, wherein:

the plurality of lines of holes comprises three lines of holes disposed generally 120 degrees apart around the void pipe; and the plurality of lines of slots comprises eight lines of slots disposed generally 45 degrees apart around the void pipe, the slots in each line staggered by one region of smaller diameter relative to the slots in an adjacent line.

11. The drain field assembly recited in claim 1, wherein:

the plurality of adjacent rows comprises:

a top row along the top of the assembly, comprising a distribution pipe;

a center row comprising two void pipes; and a bottom row along the bottom of the assembly, comprising three void pipes; and the rows are disposed in a close-packed arrangement, the cylindrical axes of any three adjacent pipes defining an equilateral triangle in a plane normal to the cylindrical axes.

12. The drain field assembly recited in claim 1, further comprising a protective soil-impervious, liquid-permeable sheeting covering the top and the two sides of the assembly for protecting the holes in the distribution pipe and the holes and the slots in the void pipes from intrusion by soil.

13. The drain field assembly recited in claim 1, wherein:

the plurality of adjacent rows comprises:

a top row along the top of the assembly, comprising a distribution pipe; and a bottom row along the bottom of the assembly, comprising a plurality of void pipes; and the rows are disposed in close-packed arrangement, the cylindrical axes of any three adjacent pipes defining an equilateral triangle in a plane normal to the cylindrical axes.

14. The drain field assembly recited in claim 13, wherein:

the distribution pipe comprises a first distribution pipe;

the top row further comprises a second distribution pipe and two void pipes, the second distribution pipe adjacent the first distribution pipe, one void pipe adjacent the first distribution pipe and the other void pipe adjacent the second distribution pipe, the void pipes each along an outer edge of the top row; and the bottom row comprises four void pipes and a third distribution pipe, two adjacent void pipes on either side of the third distribution pipe.

15. The drain field assembly recited in claim 13, wherein:

the distribution pipe comprises a first distribution pip;

the top row further comprises a second distribution pipe and four void pipes, the second distribution pipe adjacent the first distribution pipe, two void pipes on either side of the first and the second distribution pipes; and the bottom row comprises six void pipes and a third distribution pipe, three adjacent void pipes on either side of the third distribution pipe.

16. A drain field assembly having a top, a bottom, and two sides for use with a sewage disposal system, the assembly comprising a plurality of subassemblies of pipes, each subassembly comprising:

a generally cylindrical distribution pipe having a first end, a second end, a cylindrical axis, a cylindrical cross section, a first half and a second half defined by an imaginary generally horizontal plane bisecting the distribution pipe along the cylindrical axis and through the cylindrical cross section, a wall, and a plurality of holes through the wall, the holes distributed along the second half;

a plurality of generally cylindrical void pipes for receiving effluent, retaining the effluent for a time, and redistributing the effluent, each void pipe having a cylindrical axis, a wall, a plurality of holes through the wall, and a plurality of slots through the wall, the slots smaller than the holes;

three rows of pipes positioned in a close-packed arrangement having a generally triangular cross section, the cylindrical axes thereof generally parallel to each other and to the sides of the subassembly, the three rows comprising:

a first row comprising one distribution pipe and two void pipes, one void pipe on either side of the distribution pipe;

a second row comprising two void pipes, the distribution pipe holes facing the second row; and a third row comprising one void pipe;

wherein in use a plurality of subassemblies are positioned in a trench, with at least one subassembly having the first row as a top row, the distribution pipe of the top row connected to a source of effluent to be treated, the effluent flowing from the distribution pipe through the distribution pipe holes, into adjacent void pipes through the void pipe holes and slots, and into the trench.

17. The drain field assembly recited in claim 16, comprising three subassemblies, wherein the three subassemblies are configured in a generally side-by-side close-packed arrangement having five pipes atop six pipes atop seven pipes, the five-pipe row comprising the distribution pipe connectable to a source of effluent as a central pipe.

18. The drain field assembly recited in claim 17, wherein the distribution pipe of the five-pipe layer is capped to prevent liquid effluent from escaping our from the second end, and further for preventing soil from entering the second end.

19. The drain field assembly recited in claim 18, further comprising a protective soil-impervious, liquid permeable sheeting covering the top and the two sides of the assembly for protecting the holes in the distribution pipes and the holes and the slots in the void pipes from intrusion by soil.

20. The drain field assembly recited in claim 19, wherein the distribution pipes and the void pipes comprise corrugated pipes having alternating regions of larger diameter and smaller diameter, each region of larger diameter defining a valley having a depth defined by the difference between the larger and the smaller diameter.

21. A drain field for use with a sewage disposal system comprising:

a first and a second generally rectangular trench, each having a depth beneath ground level;

a first and a second drain field assembly dimensioned to reside within the first and the second trench, respectively, each having a top, a bottom, two sides, a width, and a height, the first assembly positioned within the first trench and the second assembly positioned within the second trench, both assemblies having the assembly bottom facing downward and each comprising:

a generally cylindrical distribution pipe for receiving liquid effluent from the sewage disposal system, the distribution pipe having an inlet at a first end, a second end, a cylindrical axis, a cylindrical cross section, a first half and a second half defined by an imaginary plane bisecting the distribution pipe along the cylindrical axis and through the cylindrical cross section, a wall, and a plurality of holes through the wall, the holes distributed along the second half;

a plurality of generally cylindrical void pipes for receiving effluent from the distribution pipe, retaining the effluent for a time, and distributing the effluent to an area of soil, each void pipe having a cylindrical axis, a wall, a plurality of holes through the wall, and a plurality of slots through the wall, the slots smaller than the holes; wherein:

the distribution pipe is positioned along the top of the assembly with the second half facing the bottom of the assembly;

the distribution pipe and the void pipes are situated in a plurality of adjacent rows, the cylindrical axes of the distribution pipe and the void pipes generally parallel to each other and to the sides of the drain field assembly, with one row comprising void pipes along the bottom of the assembly;

an effluent pipe connectable to an outlet of the sewage disposal system;

a connector having an inlet connected to the effluent pipe and further having a first and a second outlet connected, respectively, to the distribution pipes of the first and the second assembly;

backfill material sufficient to cover the first and the second drain field assembly.

22. The drain field recited in claim 21, wherein the first and the second drain field assemblies are disposed in generally parallel fashion side by side.

* * * * *